US008550141B2

(12) United States Patent
Ding

(10) Patent No.: US 8,550,141 B2
(45) Date of Patent: Oct. 8, 2013

(54) HOLLOW GLASS DEVICE WITH BUILT-IN WINDOW SHUTTER

(75) Inventor: Guokun Ding, Guangzhou (CN)

(73) Assignee: CMECH (Guangzhou) Industrial Ltd., Guangzhou (CN)

( * ) Notice: Subject to any disclaimer, the term of this patent is extended or adjusted under 35 U.S.C. 154(b) by 355 days.

(21) Appl. No.: 12/958,628

(22) Filed: Dec. 2, 2010

(65) Prior Publication Data

US 2012/0031570 A1 Feb. 9, 2012

(30) Foreign Application Priority Data

Aug. 4, 2010 (CN) ..... 2010 2 0289432 U

(51) Int. Cl.
*E06B 9/26* (2006.01)

(52) U.S. Cl.
USPC ..... 160/107; 160/168.1 R; 160/176.1 R

(58) Field of Classification Search
USPC .... 160/107, 168.1 R, 176.1 R, 173 R, 177 R, 160/172 R, 190, 193, 84.06
See application file for complete search history.

(56) References Cited

U.S. PATENT DOCUMENTS

| | | | | | |
|---|---|---|---|---|---|
| 1,426,224 | A | * | 8/1922 | Schneider | 16/218 |
| 1,463,877 | A | * | 8/1923 | Dickinson | 16/218 |
| 2,128,163 | A | * | 8/1938 | Pratt | 160/170 |
| 2,268,858 | A | * | 1/1942 | Dodge | 160/172 R |
| 2,490,295 | A | * | 12/1949 | Fisher | 49/64 |
| 2,639,766 | A | * | 5/1953 | Pratt | 160/40 |
| 3,204,690 | A | * | 9/1965 | Nyc | 160/176.1 R |
| 3,460,601 | A | * | 8/1969 | Garnett | 160/168.1 R |
| 3,473,597 | A | * | 10/1969 | Chevaux | 160/172 R |
| 3,534,801 | A | * | 10/1970 | Bolden | 160/172 R |
| 4,456,049 | A | * | 6/1984 | Vecchiarelli | 160/176.1 R |
| 4,480,674 | A | * | 11/1984 | Anderson | 160/107 |
| 4,588,012 | A | * | 5/1986 | Anderson | 160/174 R |
| 4,673,018 | A | * | 6/1987 | Judkins | 160/84.06 |
| 4,723,586 | A | * | 2/1988 | Spangenberg | 160/107 |
| 4,817,698 | A | * | 4/1989 | Rossini et al. | 160/107 |
| 4,884,613 | A | * | 12/1989 | Komori et al. | 160/107 |
| 4,959,035 | A | * | 9/1990 | Murasaki | 446/40 |
| 5,107,916 | A | * | 4/1992 | van Roermund et al. | 160/6 |

(Continued)

FOREIGN PATENT DOCUMENTS

| | | |
|---|---|---|
| CN | 200510042308.3 | 7/2005 |
| CN | 200520079933 | 6/2006 |
| CN | 200720169880 | 10/2008 |
| CN | 200820102103.9 | 3/2009 |

*Primary Examiner* — Blair M Johnson
*Assistant Examiner* — Jaime F Cardenas-Garcia
(74) *Attorney, Agent, or Firm* — Robert P. Michal; Lucas & Mercanti, LLP

(57) ABSTRACT

A novel hollow glass device with a built-in window shutter includes an inner glass layer, an outer glass layer, a window shutter sandwiched between the inner and outer glass layers, and a frame sealing and connecting the inner and outer glass layers. The window shutter is formed by connecting a plurality of blades by a turning cord in series, and the frame is provided with a window shutter lift mechanism and a window shutter turning mechanism. The window shutter turning mechanism employs a rigid component as a transmission structure, which is not liable to deformation and extension phenomena and loosening and is firm, practical and reliable, thereby ensuring long-term normal use of the hollow glass device. The hollow glass device is overall structurally compact and conveniently and quickly operable, and therefore can easily be further spread and used in more broad fields.

7 Claims, 4 Drawing Sheets

(56) References Cited

U.S. PATENT DOCUMENTS

| | | | | |
|---|---|---|---|---|
| 5,396,944 | A * | 3/1995 | Rossini | 160/107 |
| 5,996,668 | A * | 12/1999 | DeBlock et al. | 160/107 |
| 6,059,006 | A * | 5/2000 | Rossini | 160/107 |
| 6,065,524 | A * | 5/2000 | Rossini | 160/107 |
| 6,076,588 | A * | 6/2000 | Swiszcz et al. | 160/168.1 V |
| 6,401,790 | B1 * | 6/2002 | Dai et al. | 160/107 |
| 6,601,633 | B2 * | 8/2003 | Sun et al. | 160/107 |
| 6,701,669 | B1 * | 3/2004 | Yorgason | 49/82.1 |
| 7,000,670 | B2 * | 2/2006 | Kwon et al. | 160/107 |
| 7,033,304 | B2 * | 4/2006 | Chuang et al. | 482/45 |
| 7,124,803 | B2 * | 10/2006 | Jin et al. | 160/107 |
| 7,191,817 | B2 * | 3/2007 | Nicolosi | 160/84.06 |
| 7,337,824 | B2 * | 3/2008 | Berger | 160/107 |
| 7,475,715 | B2 * | 1/2009 | Gardner et al. | 160/107 |
| 7,543,623 | B2 * | 6/2009 | Allardyce et al. | 160/107 |
| 7,581,579 | B2 * | 9/2009 | McCormick et al. | 160/309 |
| 7,640,964 | B2 * | 1/2010 | Berger | 160/107 |
| 7,669,633 | B2 * | 3/2010 | Berger | 160/107 |
| 8,256,489 | B2 * | 9/2012 | Berger | 160/107 |
| 2003/0066614 | A1 * | 4/2003 | Sun et al. | 160/107 |
| 2003/0075285 | A1 * | 4/2003 | Anderson et al. | 160/90 |
| 2003/0173036 | A1 * | 9/2003 | Kwon et al. | 160/107 |
| 2004/0211528 | A1 * | 10/2004 | Jin et al. | 160/107 |
| 2004/0226665 | A1 * | 11/2004 | Berger | 160/107 |
| 2006/0118250 | A1 * | 6/2006 | Jin et al. | 160/107 |
| 2006/0283559 | A1 * | 12/2006 | McCormick et al. | 160/168.1 P |
| 2007/0017644 | A1 * | 1/2007 | Berger | 160/107 |
| 2008/0029226 | A1 * | 2/2008 | Huang | 160/107 |
| 2008/0083511 | A1 * | 4/2008 | Hung | 160/168.1 R |
| 2008/0179018 | A1 * | 7/2008 | Berger | 160/107 |
| 2008/0216966 | A1 * | 9/2008 | Ben-David | 160/167 R |
| 2011/0042017 | A1 * | 2/2011 | Jin | 160/107 |
| 2012/0061031 | A1 * | 3/2012 | Zhang | 160/107 |

* cited by examiner

HOLLOW GLASS DEVICE WITH BUILT-IN WINDOW SHUTTER

CROSS-REFERENCE TO RELATED APPLICATION

The present application claims priority of Chinese Patent Application CN201020289432.6 filed Aug. 4, 2010, the entire contents of which is incorporated herein by reference.

FIELD OF THE INVENTION

The present invention relates to a hollow glass device, particularly to a novel hollow glass device with a built-in window shutter.

BACKGROUND OF THE INVENTION

For environment-friendly and energy-saving purpose, hollow glass is currently applied extensively worldwide because of unique characteristics such as heat insulation, sound insulation, and resistance against window frost and against dust pollution. For example, the German government enacts to provide that all the buildings must employ hollow glass and ordinary glass is forbidden for door or window glass pane; in the North America, the amount of use of hollow glass for windows already amounts to 95%. As the living standard is increasingly improved, hollow glass is more and more used in China and tends to be popularized.

Since hollow glass is mostly used as door or window pane which is light permeable, various curtains or window shutters need to be additionally provided to block sunlight and people's observation. However, curtains, being directly hung outside glass, are likely to become dirty and damaged, so they need to be often cleaned and maintained, which is very inconvenient. Therefore, the practitioners in the art begin to develop and research a kind of hollow glass device with a window shutter sandwiched between the hollow glass, and the hollow glass device can not only achieve the object of light adjustment and sunshade, but also keep the window shutter permanently clean and free of cleaning. However, there is a drawback with the window shutter of the current hollow glass device, that is, a window shutter turning mechanism and a window shutter elevating mechanism both employ a cord as a transmission member. Since the cord is made of a soft material, it is liable to deformation and extension and even lessening after long-term use, the turning and elevation of the window shutter cannot be accurately and quickly and effectively controlled, thereby limiting spread and use of the hollow glass device.

SUMMARY OF THE INVENTION

An object of the present invention is to overcome drawbacks and shortcomings in the prior art and to provide a novel hollow glass device which has a built-in window shutter and is structurally compact and reasonable, conveniently and quickly operable, precise, practical and reliable In order to achieve the above object, the present invention is implemented according to the following technical solutions:

A novel hollow glass device with a built-in window shutter comprises an inner glass layer, an outer glass layer, a window shutter sandwiched between the inner and outer glass layers, and a frame sealing and connecting the inner and outer glass layers, wherein the window shutter is formed by connecting a plurality of blades by a turning cord in series, and the frame is provided with a window shutter lift mechanism and a window shutter turning mechanism; The window shutter turning mechanism comprises: a turning traction switch comprising a turning traction magnet inner slide assembly and a turning traction magnet outer slide assembly, wherein the turning traction magnet inner slide assembly is provided in a frame column and the turning traction magnet outer slide assembly is provided outside the frame column and located corresponding to and cooperating with the turning traction magnet inner slide assembly in position; A turning transmission member comprising a transmission gear train and a transmission rack, wherein a power input end of the transmission gear train engages with and jointly drives with a toothed portion of the transmission rack, a power output end is closely fitted with and fixedly connected to a horizontal rotation shaft disposed in a frame beam, a connecting portion of the transmission rack is linearly reciprocally jointly driven with the turning traction magnet inner slide assembly through a connecting push rod; a blade turning member comprising a roller seat and a turning roller, wherein the roller seat is fixed in the frame beam, the turning roller is rotatably mounted on the roller seat and closely fitted with and fixedly connected to the horizontal rotation shaft, and the turning cord passes through the roller seat, is wound around the turning roller and cooperates with the turning roller.

Furthermore, the transmission gear train comprises a first gear, a second gear and a third gear with different transmission ratios, wherein the first gear is engaged with and jointly driven with the toothed portion of the transmission rack, the second gear is coaxially fastened to the first gear, the third gear is engaged with and jointly driven with the second gear and fastened to the horizontal rotation shaft.

Furthermore, the above window shutter lift mechanism comprises: a lift traction switch comprising a lift traction magnet inner slide assembly and a lift traction magnet outer slide assembly, wherein the lift traction magnet inner slide assembly is disposed in the frame column and a rotatable wheel is provided at a top portion thereof, the lift traction magnet outer slide assembly is provided outside the frame column and located corresponding to and cooperating with the lift traction magnet inner slide assembly in position; a lift pull cord positioning member comprising an "L"-shape seat and a cover, wherein the "L"-shaped seat is disposed in the frame column and above the lift traction magnet inner slide assembly, and the cover is firmly connected to the "L"-shaped seat via bolts; a lift pull cord which one end is wound and fixed to the lift pull cord positioning member, and which the other end passes in turn through each of the blades after winding around the rotatable wheel of the lift traction magnet inner slide assembly, a first direction-changing rubber wheel at a corner of the frame and a second direction-changing rubber wheel in the roller seat in turn.

Furthermore, at the corresponding locations of the "L"-shaped seat and the cover of the lift pull cord positioning member are provided teeth which engages with one another to lock the lift pull cord, a bent portion of the "L"-shaped seat is provided with an insertion hole for insertion of the lift pull cord, another bent portion is provided with a boss for the winding of the lift pull cord.

Further, at the bottom of the lift traction magnet inner slide assembly is provided a counterweight, a counterweight bar is provided at a bottom end of the window shutter, and a weight of the counterweight is at least a sum of a weight of the counterweight bar and a weight of the blades.

Furthermore, a lower limiting block is provided in the frame column and located below the lift traction magnet inner slide assembly and provided with a limiting magnet attracted to the counterweight for positioning purpose.

Furthermore, a linear guide rail seat is provided outside the frame column, the turning traction magnet outer slide assembly and lift traction magnet outer slide assembly are respectively snap-fitted to and slidable on the linear guide rail seat.

Furthermore, anti-corrosion and anti-permeation sealant encapsulates a periphery of the frame.

The present invention has the following advantageous effects as compared with the prior art:

1) The window shutter turning mechanism employs a rigid component as a transmission structure, which is not liable to deformation and extension phenomena and loosening issue and is firm, practical and reliable, thereby ensuring long-term normal use of the hollow glass device;

2) The hollow glass device is overall structurally compact and reasonable and conveniently and quickly operable, and therefore can easily be further spread and used in more broad fields.

To make the present invention more clearly comprehensible, preferred embodiments of the present invention will be described with reference to the drawings.

BRIEF DESCRIPTION OF THE ACCOMPANYING DRAWINGS

FIG. 1 is a schematic view showing the structure of the present invention;

FIGS. 2*a* and 2*b* are schematic views showing the structure of a window shutter turning mechanism;

DETAILED DESCRIPTION OF THE PREFERRED EMBODIMENTS

Figure 1:
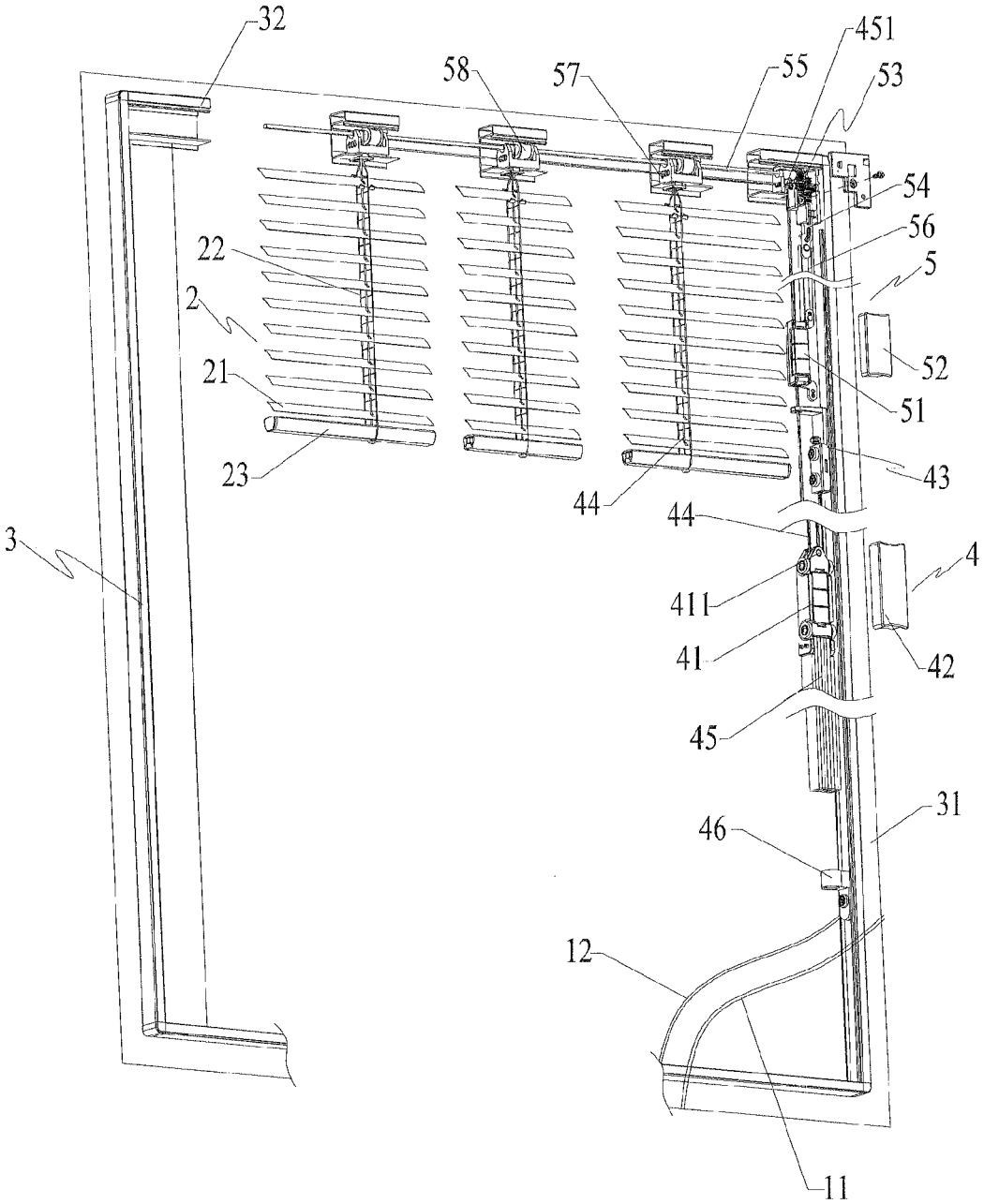
Figure 2A:
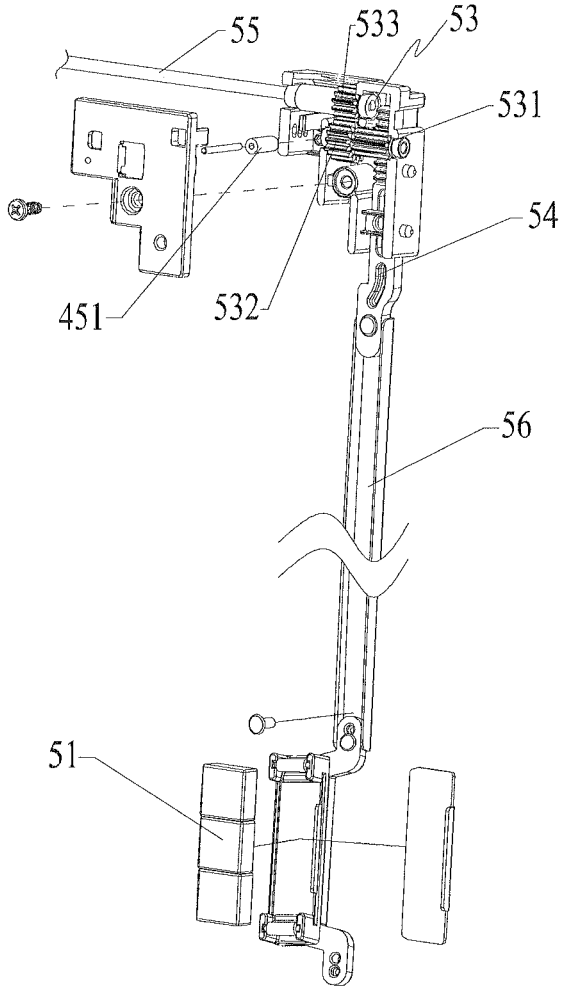
Figure 2B:
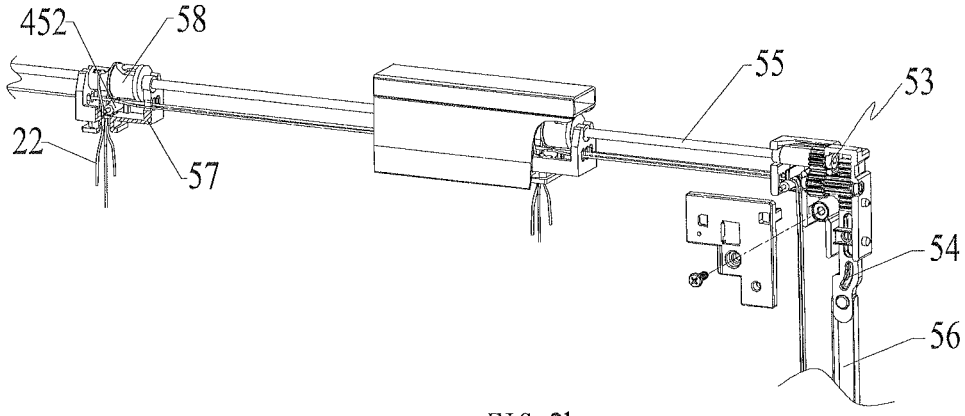
Figure 3:
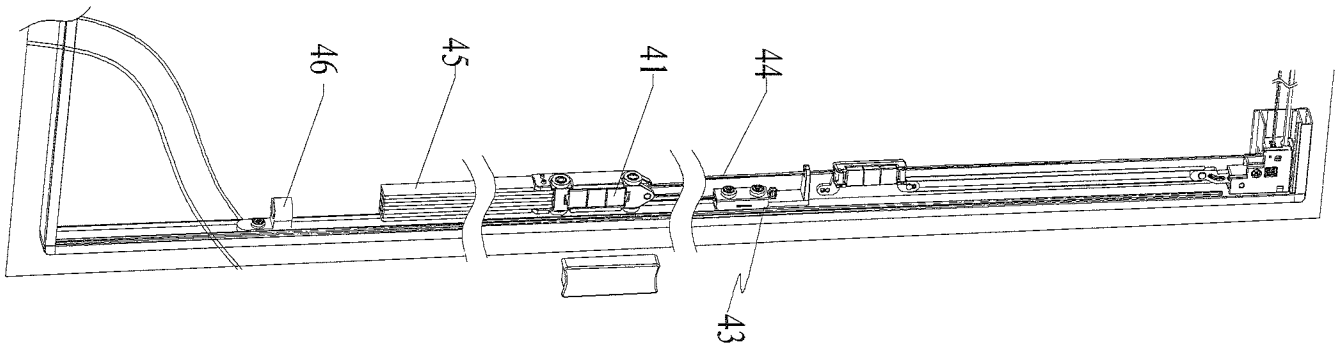
FIG. 3 is a schematic view of a window shutter lift mechanism.
Figure 4:
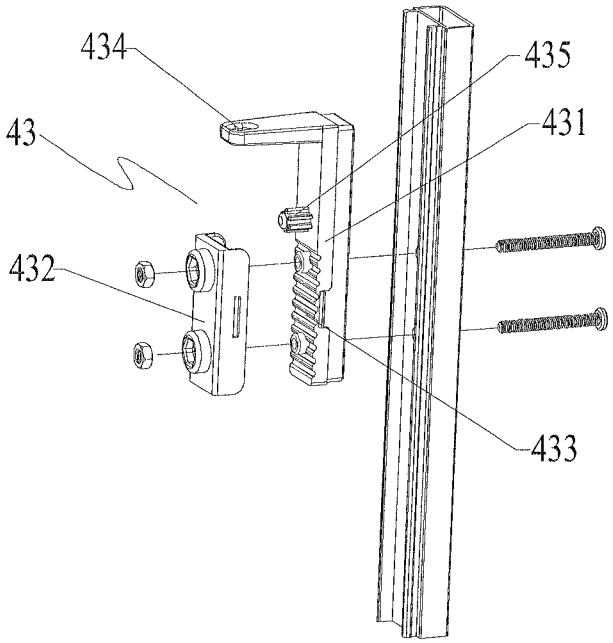
FIG. 4 is a schematic view of a lift pull cord positioning member.
Figure 5:
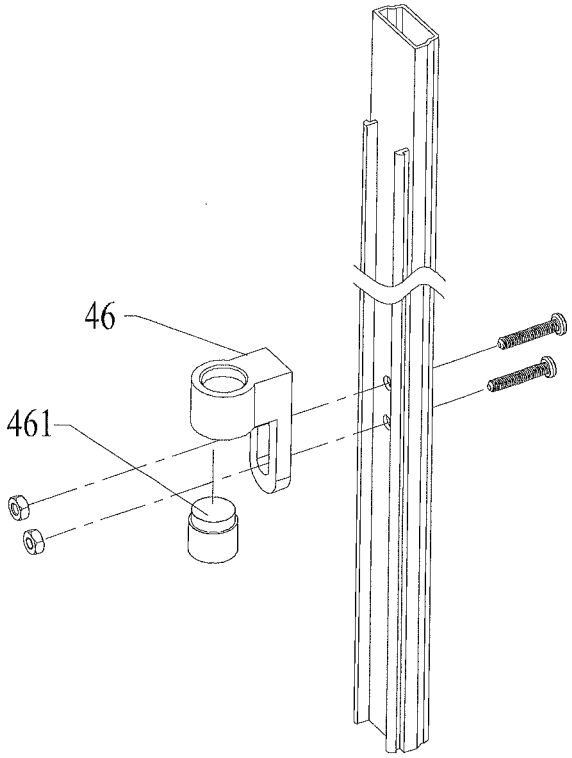
FIG. 5 is a schematic view of a lower limiting block.

As shown in FIGS. 1-5, a novel hollow glass device with a built-in window shutter according to the present invention comprises an inner glass layer 11, an outer glass layer 12, a window shutter 2 sandwiched between the inner and outer glass layers, and a frame 3 sealing and connecting the inner and outer glass layers, wherein the window shutter 2 is formed by connecting a plurality of blades 21 by a turning cord 22 in series, and the frame 3 is provided with a window shutter lift mechanism 4 and a window shutter turning mechanism 5.

The window shutter turning mechanism 5 comprises: a turning traction switch comprising a turning traction magnet inner slide assembly 51 and a turning traction magnet outer slide assembly 52, wherein the turning traction magnet inner slide assembly 51 is provided in a frame column 31 and the turning traction magnet outer slide assembly 52 is provided outside the frame column 31 and located corresponding to and cooperating with the turning traction magnet inner slide assembly 51; a turning transmission member comprising a transmission gear train 53 and a transmission rack 54, wherein a power input end of the transmission gear train 53 engages with and jointly drives with a toothed portion of the transmission rack 54, a power output end is closely fitted with and fixedly connected to a horizontal rotation shaft 55 disposed in a frame beam 32, a connecting portion of the transmission rack 54 is linearly reciprocally jointly driven with the turning traction magnet inner slide assembly 51; a blade turning member comprising a roller seat 57 and a turning roller 58, wherein the roller seat 57 is fixed in the frame beam 32, the turning roller 58 is rotatably mounted on the roller seat 57 and closely fitted with and fixedly connected to the horizontal rotation shaft 55, and the turning cord 22 passes through the roller seat 57, is wound around the turning roller 58 and cooperates with the turning roller 58.

Furthermore, the transmission gear train 53 comprises a first gear 531, a second gear 532 and a third gear 533 with different transmission ratios, wherein the first gear 531 is engaged with and jointly driven with the toothed portion of the transmission rack 54, the second gear 532 is coaxially fastened to the first gear 531, the third gear 533 is engaged with and jointly driven with the second gear 532 and fastened to the horizontal rotation shaft 55.

The above window shutter lift mechanism 4 comprises: a lift traction switch comprising a lift traction magnet inner slide assembly 41 and a lift traction magnet outer slide assembly 42, wherein the lift traction magnet inner slide assembly 41 is disposed in the frame column 31 and a rotatable wheel 411 is provided at a top portion thereof, the lift traction magnet outer slide assembly 42 is provided outside the frame column 31 and located corresponding to and cooperating with the lift traction magnet inner slide assembly 41; a lift pull cord positioning member 43 comprising an "L"-shape seat 431 and a cover 432, wherein the "L"-shaped seat 431 is disposed in the frame column 31 and above the lift traction magnet inner slide assembly 41, and the cover 432 is firmly connected to the "L"-shaped seat 431 via bolts; a lift pull cord 44 which one end is wound and fixed to the lift pull cord positioning member 42, and which the other end passes in turn through each of the blades 21 after winding around the rotatable wheel 411 of the lift traction magnet inner slide assembly, a first redirecting rubber wheel 451 at a corner of the frame and a second redirecting rubber wheel 452 in the roller seat 57 in turn.

Furthermore, at the corresponding locations of the "L"-shaped seat 431 and the cover 432 of the lift pull cord positioning member 43 are provided teeth 433 which engages with one another to lock the lift pull cord, a bent portion of the "L"-shaped seat 43 is provided with an insertion hole 434 for insertion of the lift pull cord, another bent portion is provided with a boss 435 for the winding of the lift pull cord. Preferably, at the bottom of the lift traction magnet inner slide assembly 41 is provided a counterweight 45, a counterweight bar 23 is provided at a bottom end of the window shutter, and a weight of the counterweight 45 is at least a sum of a weight of the counterweight bar 23 and a weight of the blades 21; a lower limiting block 46 is provided in the frame column 31 and located below the lift traction magnet inner slide assembly 41 and provided with a limiting magnet 461 attracted to the counterweight 45 for positioning purpose.

In another aspect, a linear guide rail seat is provided outside the frame column 31, the turning traction magnet outer slide assembly 51 and lift traction magnet outer slide assembly 41 are respectively snap-fitted to and slidable on the linear guide rail seat. Furthermore, anti-corrosion and anti-permeation sealant encapsulates a periphery of the frame 3.

The working principle of the present invention is as follows:

When the window shutter needs to be turned, the turning traction magnet outer slide assembly 52 is moved upwardly (or downwardly), bringing the turning traction magnet inner slide assembly 51 to synchronously move upwardly (or downwardly) therewith thereby pushing a connection push rod 56 and the, transmission rack 54 to synchronously move upwardly (or downwardly). The transmission rack 54, during the movement, brings the first gear 531 and the second gear 532 to rotate counter-clockwise (or clockwise), thereby bringing the third gear 533 to rotate clockwise (or counter-clockwise). The horizontal rotation shaft 55 or turning roller 58 rotates synchronously along with the third gear 533 in the same direction, thereby bringing the turning cord 22 to swing to the left (or to the right) and bringing the blades 21 to correspondingly turn a certain angle and achieving the purpose of sunshade and light adjustment.

When the window shutter needs to be hoisted and lowered, the lift traction magnet outer slide assembly 42 is moved upwardly (or downwardly), bringing the lift traction magnet inner slide assembly 41 to synchronously move upwardly (or downwardly) therewith. Since the lift traction magnet inner slide assembly 41 functions like a movable pulley, while it rises (or falls), a portion of the lift pull cord 44 in the hollow glass will extend downwardly and become longer (or rise to become shorter), thereby achieving rise and fall of the blades 21. When the lift traction magnet inner slide assembly 41 falls to the counterweight 45 and attracts with the limiting magnet 461 of the lower limiting block 46, the lift traction magnet inner slide assembly 41 will be attracted and positioned.

The present invention is not limited to the above embodiments. If various modification or variations to the present invention do not depart from the spirit and scope of the present invention, the present invention also intends to contain the various modifications and variations if they fall within the scope of claims of the present invention and equivalent technologies.

What is claimed is:

1. A novel hollow glass device with a built-in window shutter comprising an inner glass layer, an outer glass layer, a window shutter sandwiched between the inner and outer glass layers, and a frame sealing and connecting the inner and outer glass layers, wherein the window shutter is formed by connecting a plurality of blades by a turning cord in series, and the frame is provided with a window shutter lift mechanism and a window turning mechanism, the window shutter turning mechanism comprising:

a turning traction switch comprising a turning traction magnet inner slide assembly and a turning traction magnet outer slide assembly, wherein the turning traction magnet inner slide assembly is provided in a frame column and the turning traction magnet outer slide assembly is provided outside the frame column and located corresponding to and cooperating with the turning traction magnet inner slide assembly in position;

a turning transmission member comprising a transmission gear train and a transmission rack, wherein a power input end of the transmission gear train engages with and jointly drives with a toothed portion of the transmission rack, a power output end is closely fitted with and fixedly connected to a horizontal rotation shaft disposed in a frame beam, a connecting portion of the transmission rack is linearly reciprocally jointly driven with the turning traction magnet inner slide assembly through a connecting push rod;

a blade turning member comprising a roller seat and a turning roller, wherein the roller seat is fixed in the frame beam, the turning roller is rotatably mounted on the roller seat and closely fitted with and fixedly connected to the horizontal rotation shaft, and the turning cord passes through the roller seat, is wound around the turning roller and cooperates with the turning roller;

wherein the window shutter lift comprises:

a lift traction switch comprising a lift traction magnet inner slide assembly and a lift traction magnet outer slide assembly, wherein the lift traction magnet inner slide assembly is disposed in the frame column and a rotary wheel is provided at a top portion thereof, the lift traction magnet outer slide assembly is provided outside the frame column and located corresponding to and cooperating with the lift traction magnet inner slide assembly in position;

a lift pull cord positioning member comprising an "L"-shape seat and a cover, wherein the "L"-shaped seat is disposed in the frame column and above the lift traction magnet inner slide assembly, and the cover is firmly connected to the "L"-shaped seat via bolts; and a lift pull cord which one end is wound and fixed to the lift pull cord positioning member, and which the other end passes in turn through each of the blades after winding around the rotatable wheel of the lift traction magnet inner slide assembly, a hole in the lift pull cord positioning member, a first direction-changing rubber wheel at a corner of the frame and a second direction-changing rubber wheel in the roller seat in turn.

2. The novel hollow glass device with a built-in window shutter according to claim 1, wherein the transmission gear train comprises a first gear, a second gear and a third gear with different transmission ratios, wherein the first gear is engaged with and jointly driven with the toothed portion of the transmission rack, the second gear is coaxially fastened to the first gear, the third gear is engaged with and jointly driven with the second gear and fastened to the horizontal rotation shaft.

3. The novel hollow glass device with a built-in window shutter according to claim 1, wherein at the corresponding locations of the "L"-shaped seat and the cover of the lift pull cord positioning member are provided teeth which engage with one another to lock the lift pull cord, a bent portion of the "L"-shaped seat is provided with an insertion hole for insertion of the lift pull cord, and another bent portion is provided with a boss for the winding of the lift pull cord.

4. The novel hollow glass device with a built-in window shutter according to claim 1, wherein at the bottom of the lift traction magnet inner slide assembly is provided a counterweight, a counterweight bar is provided at a bottom end of the window shutter, and the entire weight of the counterweight is at least a sum of the entire weight of the counterweight bar and the entire weight of the blades.

5. The novel hollow glass device with a built-in window shutter according to claim 4, wherein a lower limiting block is provided in the frame column and located below the lift traction magnet inner slide assembly and provided with a limiting magnet attracted to the counterweight for positioning purposes.

6. The novel hollow glass device with a built-in window shutter according to claim 1, wherein a linear guide rail seat is provided outside the frame column, the turning traction magnet outer slide assembly and lift traction magnet outer slide assembly are respectively snap-fitted to and slidable on the linear guide rail seat.

7. The novel hollow glass device with a built-in window shutter according to claim 1, wherein anti-corrosion and anti-permeation sealant encapsulates a periphery of the frame.

* * * * *